US005546767A

United States Patent [19]

Dray et al.

[11] Patent Number: 5,546,767

[45] Date of Patent: Aug. 20, 1996

[54] CRYOGENIC RECTIFICATION SYSTEM FOR PRODUCING DUAL PURITY OXYGEN

[75] Inventors: James R. Dray, Kenmore; David R. Parsnick, Tonawanda; Theodore F. Fisher, Amherst; Michael W. Wisz, Tonawanda, all of N.Y.

[73] Assignee: Praxair Technology, Inc., Danbury, Conn.

[21] Appl. No.: 536,589

[22] Filed: Sep. 29, 1995

[51] Int. Cl.[6] ..... F25J 3/02

[52] U.S. Cl. ..... 62/646; 62/654

[58] Field of Search ..... 62/24, 25, 38, 62/41

[56] References Cited

U.S. PATENT DOCUMENTS

| | | | |
|---|---|---|---|
| 3,277,655 | 10/1966 | Geist et al. | 62/29 |
| 4,464,191 | 8/1984 | Erickson | 62/31 |
| 4,704,148 | 11/1987 | Kleinberg | 62/24 |
| 4,824,453 | 4/1989 | Rottman et al. | 62/22 |
| 5,233,838 | 8/1993 | Howard | 62/25 |
| 5,251,449 | 10/1993 | Rottmann | 62/41 |
| 5,265,429 | 11/1993 | Dray | 62/41 |
| 5,315,833 | 5/1994 | Ha et al. | 62/38 |
| 5,392,609 | 2/1995 | Girault et al. . | |
| 5,440,884 | 8/1995 | Bonaquist et al. | 62/22 |

*Primary Examiner*—Ronald C. Capossela
*Attorney, Agent, or Firm*—Stanley Ktorides

[57] ABSTRACT

A cryogenic rectification system employing a double column and two auxiliary reboilers associated with one or two auxiliary columns wherein both lower purity oxygen and higher purity oxygen is produced.

8 Claims, 4 Drawing Sheets

CRYOGENIC RECTIFICATION SYSTEM FOR PRODUCING DUAL PURITY OXYGEN

TECHNICAL FIELD

This invention relates generally to the cryogenic rectification of feed air and, more particularly, to the cryogenic rectification of feed air to produce oxygen.

BACKGROUND ART

The demand for lower purity oxygen is increasing in applications such as glassmaking, steelmaking and energy production. Lower purity oxygen is generally produced in large quantities by the cryogenic rectification of feed air in a double column wherein feed air at the pressure of the higher pressure column is used to reboil the liquid bottoms of the lower pressure column and is then passed into the higher pressure column.

Some users of lower purity oxygen, for example integrated steel mills, often require some higher purity oxygen in addition to the lower purity oxygen. Such dual purity production cannot be efficiently accomplished with a conventional lower purity oxygen plant.

Accordingly, it is an object of this invention to provide a cryogenic rectification system which can effectively and efficiently produce both lower purity oxygen and higher purity oxygen.

SUMMARY OF THE INVENTION

The above and other objects, which will become apparent to one skilled in the art upon a reading of this disclosure, are attained by the present invention, one aspect of which is:

A method for producing lower purity oxygen and higher purity oxygen comprising:

(A) at least partially condensing a first feed air portion and passing the resulting first feed air portion into a higher pressure column of a double column which also comprises a lower pressure column;

(B) at least partially condensing a second feed air portion, having a pressure less than that of the first feed air portion, and passing the resulting second feed air portion into the higher pressure column;

(C) separating feed air within the double column by cryogenic rectification to produce first oxygen-richer fluid and nitrogen-richer fluid;

(D) passing first oxygen-richer fluid from the double column into a first auxiliary column and separating the first oxygen-richer fluid within the first auxiliary column by cryogenic rectification to produce second oxygen-richer fluid having an oxygen concentration greater than that of the first oxygen-richer fluid;

(E) passing second oxygen-richer fluid from the first auxiliary column into a second auxiliary column and separating second oxygen-richer fluid within the second auxiliary column by cryogenic rectification into lower purity oxygen, having an oxygen concentration which is greater than that of the first oxygen-richer fluid and less than that of the second oxygen-richer fluid, and into higher purity oxygen, having an oxygen concentration greater than that of the lower purity oxygen; and (F) recovering lower purity oxygen and higher purity oxygen from the second auxiliary column.

Another aspect of this invention is:

Apparatus for producing lower purity oxygen and higher purity oxygen comprising:

(A) a double column comprising a higher pressure column and a lower pressure column, a first auxiliary column having a first reboiler, and a second auxiliary column having a second reboiler;

(B) means for passing feed air to the second reboiler and from the second reboiler into the higher pressure column;

(C) means for passing feed air to the first reboiler at a pressure less than that of the feed air passed to the second reboiler, and means for passing feed air from the first reboiler into the higher pressure column;

(D) means for passing fluid from the double column into the first auxiliary column;

(E) means for passing fluid from the first auxiliary column into the second auxiliary column; and (F) means for recovering lower purity oxygen from the second auxiliary column and means for recovering higher purity oxygen from the second auxiliary column.

A further aspect of the invention is:

A method for producing lower purity oxygen and higher purity oxygen comprising:

(A) at least partially condensing a first feed air portion and passing the resulting first feed air portion into a higher pressure column of a double column which also comprises a lower pressure column;

(B) at least partially condensing a second feed air portion, having a pressure less than that of the first feed air portion, and passing the resulting second feed air portion into the higher pressure column;

(C) separating feed air within the double column by cryogenic rectification to produce oxygen-richer fluid and nitrogen-richer fluid;

(D) passing oxygen-richer fluid from the double column into an auxiliary column and separating the oxygen-richer fluid within the auxiliary column by cryogenic rectification into lower purity oxygen, having an oxygen concentration greater than that of the oxygen-richer fluid, and higher purity oxygen, having an oxygen concentration greater than that of the lower purity oxygen; and (E) recovering lower purity oxygen and higher purity oxygen from the auxiliary column.

Yet another aspect of the invention is:

Apparatus for producing lower purity oxygen and higher purity oxygen comprising:

(A) a double column comprising a higher pressure column and a lower pressure column, and an auxiliary column having a first reboiler and a second reboiler;

(B) means for passing feed air to the second reboiler and from the second reboiler into the higher pressure column;

(C) means for passing feed air to the first reboiler at a pressure less than that of the feed air passed to the second reboiler, and means for passing feed air from the first reboiler into the higher pressure column;

(D) means for passing fluid from the double column into the auxiliary column; and (E) means for recovering lower purity oxygen from the auxiliary column and means for recovering higher purity oxygen from the auxiliary column.

As used herein, the term "feed air" means a mixture comprising primarily nitrogen and oxygen, such as ambient air.

As used herein, the term "lower purity oxygen" means a fluid having an oxygen concentration with the range of from 70 to 98 mole percent.

As used herein, the term "higher purity oxygen" means a fluid having an oxygen concentration equal to or greater than 99 mole percent.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein the term "reboiler" means a heat exchange device which generates column upflow vapor from column liquid. A reboiler is generally within a column but may be physically outside a column.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "recovered" means passed out of the system, i.e. actually recovered, in whole or in part, or otherwise removed from the system.

DETAILED DESCRIPTION

Figure 1:
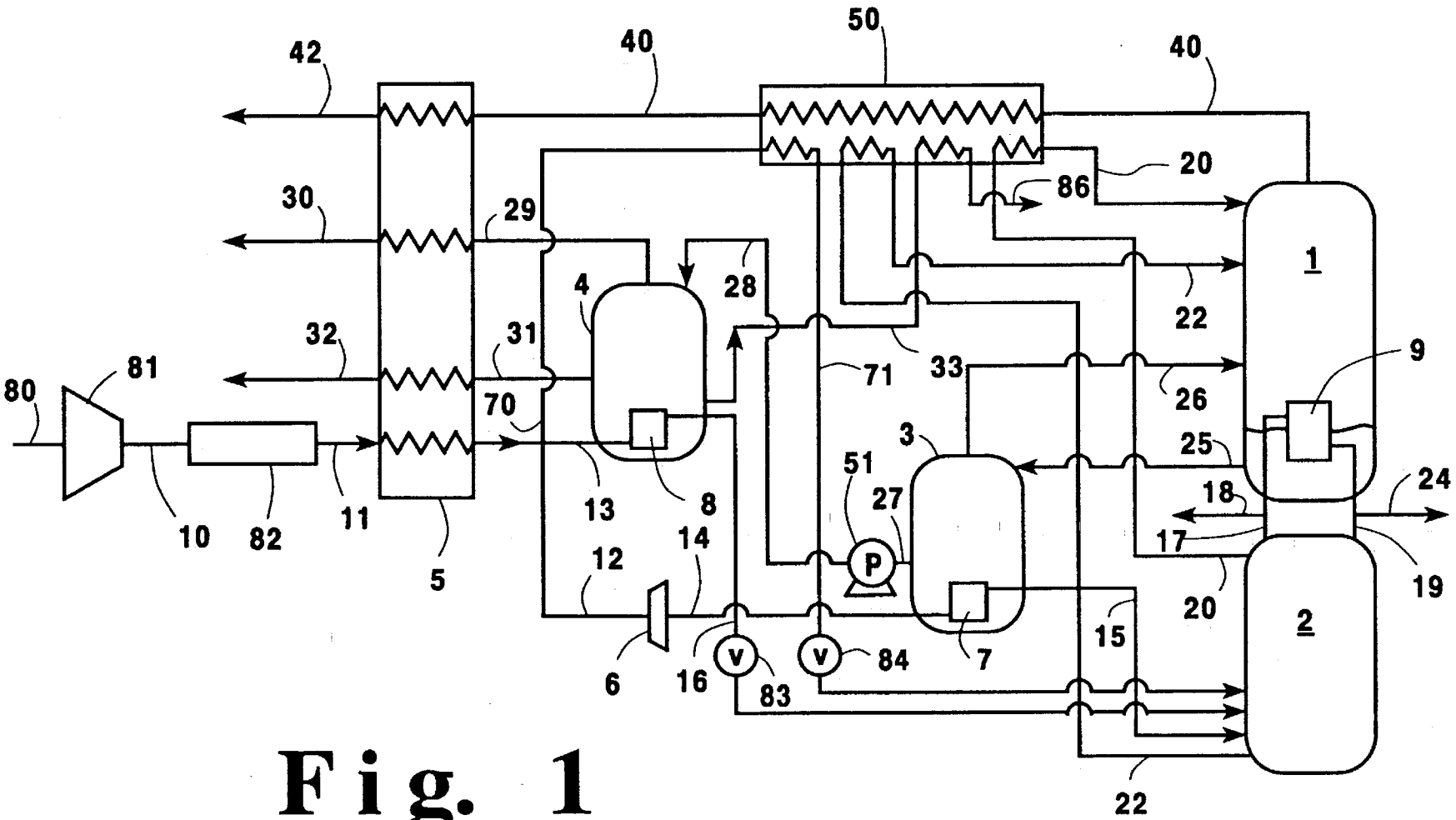
FIG. 1 is a schematic representation of one preferred embodiment of the invention.

The invention will be described in detail with reference to the Drawings. Referring now to FIG. 1, feed air 80 is compressed to a pressure within the range of from 70 to 300 pounds per square inch absolute (psia) in compressor 81. Resulting pressurized feed air 10 is cleaned of high boiling impurities such as carbon dioxide and water vapor by passage through purifier 82 and resulting feed air stream 11 is cooled by indirect heat exchanger with return streams in main heat exchanger 5.

The cryogenic rectification plant for the practice of the embodiment of the invention illustrated in FIG. 1 comprises a double column which includes lower pressure column 1 and higher pressure column 2, a first auxiliary column 3 having a first reboiler 7, and a second auxiliary column 4 having a second reboiler 8. A first portion 13 of the feed air, generally comprising from about 20 to 30 percent of feed air 80, is passed to second reboiler 8 wherein it is at least partially condensed against boiling column 4 bottom liquid. Resulting first feed air portion 16 is then passed through valve 83 and into higher pressure column 2. A fraction of stream 16 may also be passed into lower pressure column 1. A second portion 12 of the feed air, generally comprising from about 70 to 80 percent of feed air 80, is turboexpanded by passage through turboexpander 6 to a pressure less than that of first feed air portion 13 and within the range of from 50 to 90 psia to generate refrigeration. Turboexpanded second feed air portion 14 is passed to first reboiler 7 wherein it is at least partially condensed against boiling column 3 bottom liquid, and resulting second feed air portion 15 is passed into higher pressure column 2. If desired, a third feed air portion 70, generally within the range of from 1 to 5 percent of feed air 80, may be cooled by indirect heat exchange in heat exchanger 50 and resulting stream 71 passed through valve 84 and into higher pressure column 2.

Higher pressure column 2 is operating at a pressure within the range of from 50 to 90 psia. Within higher pressure column 2 the feed air is separated by cryogenic rectification into oxygen-enriched and nitrogen-enriched fluids which are passed respectively in streams 22 and 20 through heat exchanger 50 and into lower pressure column 1 which is operating at a pressure less than that of column 2 and within the range of from 15 to 25 psia. High pressure nitrogen-richer vapor, having a nitrogen concentration of at least 97 mole percent, is passed as stream 17 into main condenser 9 wherein it is condensed against boiling column 1 bottom liquid. Resulting high pressure nitrogen-richer liquid is returned to column 2 in stream 19 as reflux. If desired, a portion 18 of stream 17 may be recovered as nitrogen gas product and/or a portion 24 of stream 19 may be recovered as nitrogen liquid product.

Within lower pressure column 1 the input fluids are separated by cryogenic rectification into low pressure nitrogen-richer fluid, having a nitrogen concentration of at least 97 mole percent, and oxygen-richer fluid, having an oxygen concentration within the range of from 70 to 90 mole percent. Low pressure nitrogen-richer fluid is withdrawn from column 1 as vapor stream 40, warmed by passage through heat exchangers 50 and 5, and recovered as gaseous nitrogen stream 42.

Oxygen-richer fluid is passed as first oxygen-richer fluid stream 25 from the lower portion of column 1 into the upper portion of first auxiliary column 3 which is operating at a pressure within the range of from 18 to 30 psia. Within first auxiliary column 3 the first oxygen-richer fluid is separated by cryogenic rectification into second oxygen-richer fluid, having an oxygen concentration greater than that of the first oxygen-richer fluid and within the range of from 80 to 97 mole percent, and into remaining vapor which is passed from column 3 into column 1 in stream 26.

Second oxygen-richer fluid is withdrawn from the lower portion of first auxiliary column 3 in stream 27, pumped to a higher pressure through liquid pump 51 and passed as stream 28 into the upper portion of second auxiliary column 4, which is operating at a pressure greater than that of first auxiliary column 3 and within the range of from 25 to 100 psia. Within second auxiliary column 4 the second oxygen-richer fluid is separated by cryogenic rectification into lower purity oxygen, having an oxygen concentration greater than that of the first oxygen-richer fluid and less than that of the second oxygen-richer fluid, and into higher purity oxygen, having an oxygen concentration greater than that of the lower purity oxygen. Lower purity oxygen is withdrawn from column 4 as stream 29, warmed by passage through main heat exchanger 5 and recovered as lower purity oxygen gas 30. If desired, a portion of stream 29 may be recycled back into first auxiliary column 3. Also, ballast tanks may be used, such as on lines 16 and/or 28, to enable flow variation in the lines without impacting the columns.

Higher purity oxygen may be recovered from second auxiliary column 4 as either gas and/or liquid. FIG. 1 illustrates the recovery of higher purity oxygen in both gaseous and liquid forms. Gaseous higher purity oxygen is withdrawn from second auxiliary column 4 as stream 31, warmed by passage through main heat exchanger 5 and recovered as higher purity oxygen gas 32. Liquid higher purity oxygen is withdrawn from second auxiliary column 4 as stream 33, subcooled by passage through heat exchanger 50, and recovered as higher purity liquid oxygen 86. Some or all of stream 33 may be further processed to recover its rare gas, e.g. krypton and xenon, content. If desired some lower purity oxygen at lower pressure may be recovered from first auxiliary column 3.

Figure 2:
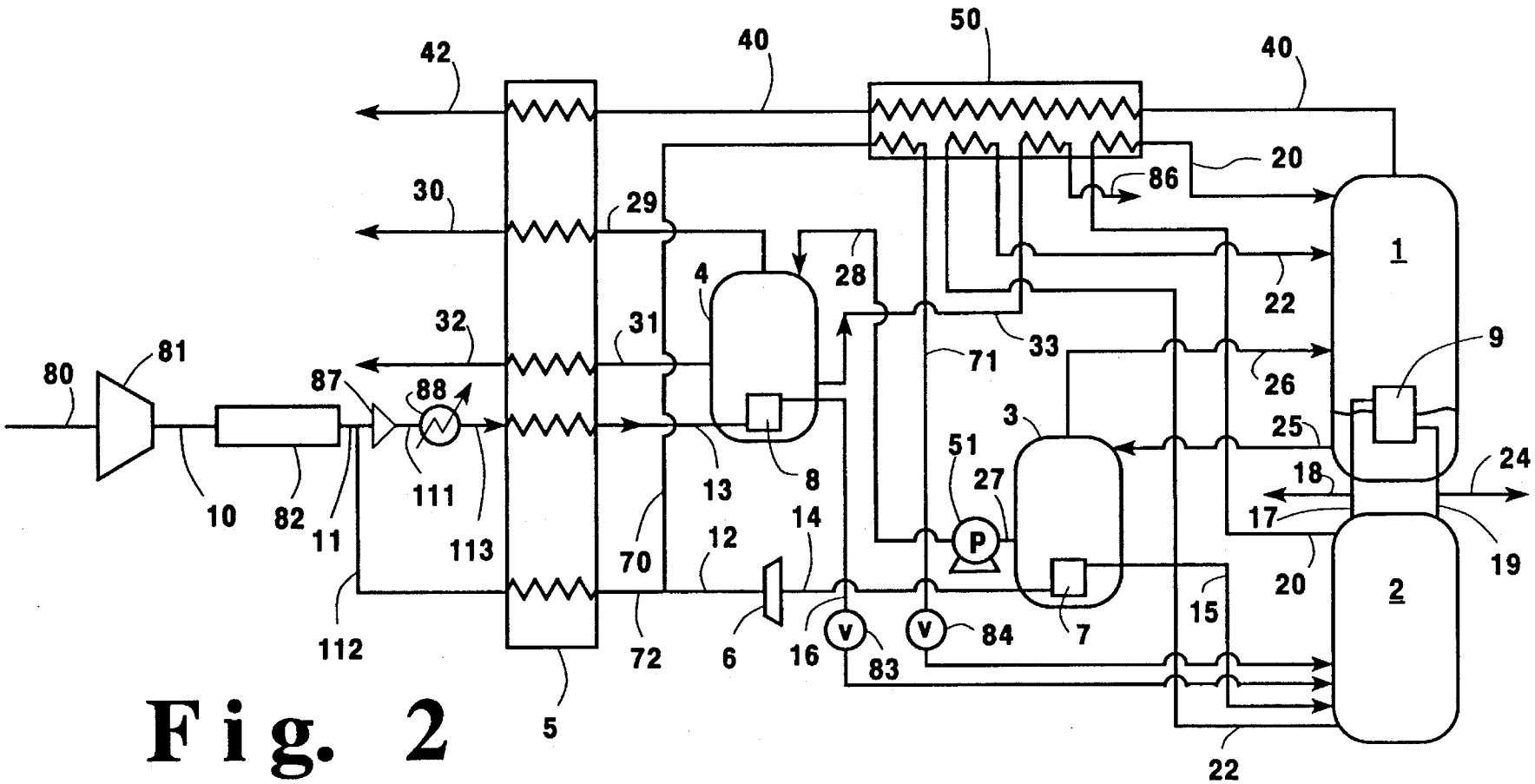
FIG. 2 is a schematic representation of another preferred embodiment of the invention.

FIG. 2 illustrates another embodiment of the invention wherein added equipment is employed to gain enhanced flexibility. The numerals of FIG. 2 correspond to those of FIG. 1 for the common elements and these common elements will not be described again in detail.

Referring now to FIG. 2 cleaned, compressed feed air 11 is divided upstream of main heat exchanger 5 in streams 111 and 112. Stream 111 is compressed to a higher pressure, generally within the range of from 100 to 300 psia, by passage through compressor 87, cooled of heat of compression in cooler 88 and passed as stream 113 through main heat exchanger 5 wherein it is cooled against return streams. The resulting stream forms first feed air portion 13 which is passed to second reboiler 8 and processed as previously described in conjunction with the embodiment illustrated in FIG. 1. Stream 112 is cooled by passage through main heat exchanger 5 against return streams and resulting stream 72 is divided into stream 70, which is processed as previously described, and into second feed air portion 12 which is turboexpanded through turboexpander 6 and further processed as previously described. Flexibility is enhanced by this embodiment because the oxygen product pressure and refrigeration production are more independent. The air condensing pressure in reboiler 8 and the inlet pressure to turboexpander 6 can be significantly different.

Figure 3:
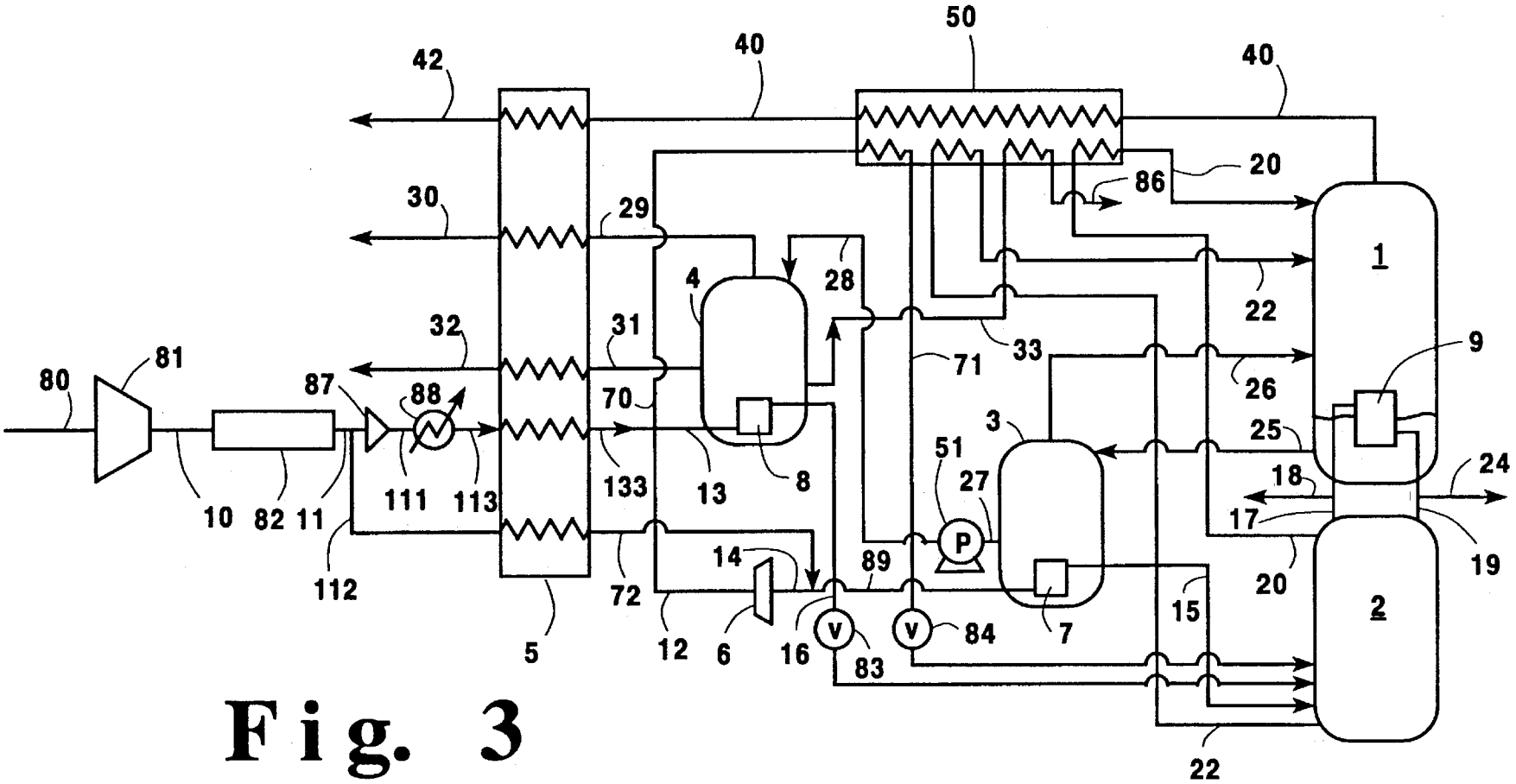
FIG. 3 is a schematic representation of another preferred embodiment of the invention which may be particularly useful when energy costs are high.

FIG. 3 illustrates another embodiment of the invention which may be particularly useful with high energy costs. The numerals of FIG. 3 correspond to those of FIGS. 1 and 2 for the common elements and these common elements will not be described again in detail.

Referring now to FIG. 3, further compressed feed air stream 113, after passing through main heat exchanger 5 is not passed entirely to second reboiler 8. Rather this stream 133 is divided into first feed air portion 13, second feed air portion 12 and additional feed air portion 70 which are processed as previously described in conjunction with the embodiment illustrated in FIG. 1. Stream 72 is passed into stream 14 downstream of turboexpander 6 and this resulting combined stream 89 comprising the second feed air portion is passed to first reboiler 7. In the practice of the embodiment illustrated in FIG. 3, feed air stream 11 may be at a lower pressure or oxygen stream 27 may be at a higher purity than those of the previously described embodiments.

Figure 4:
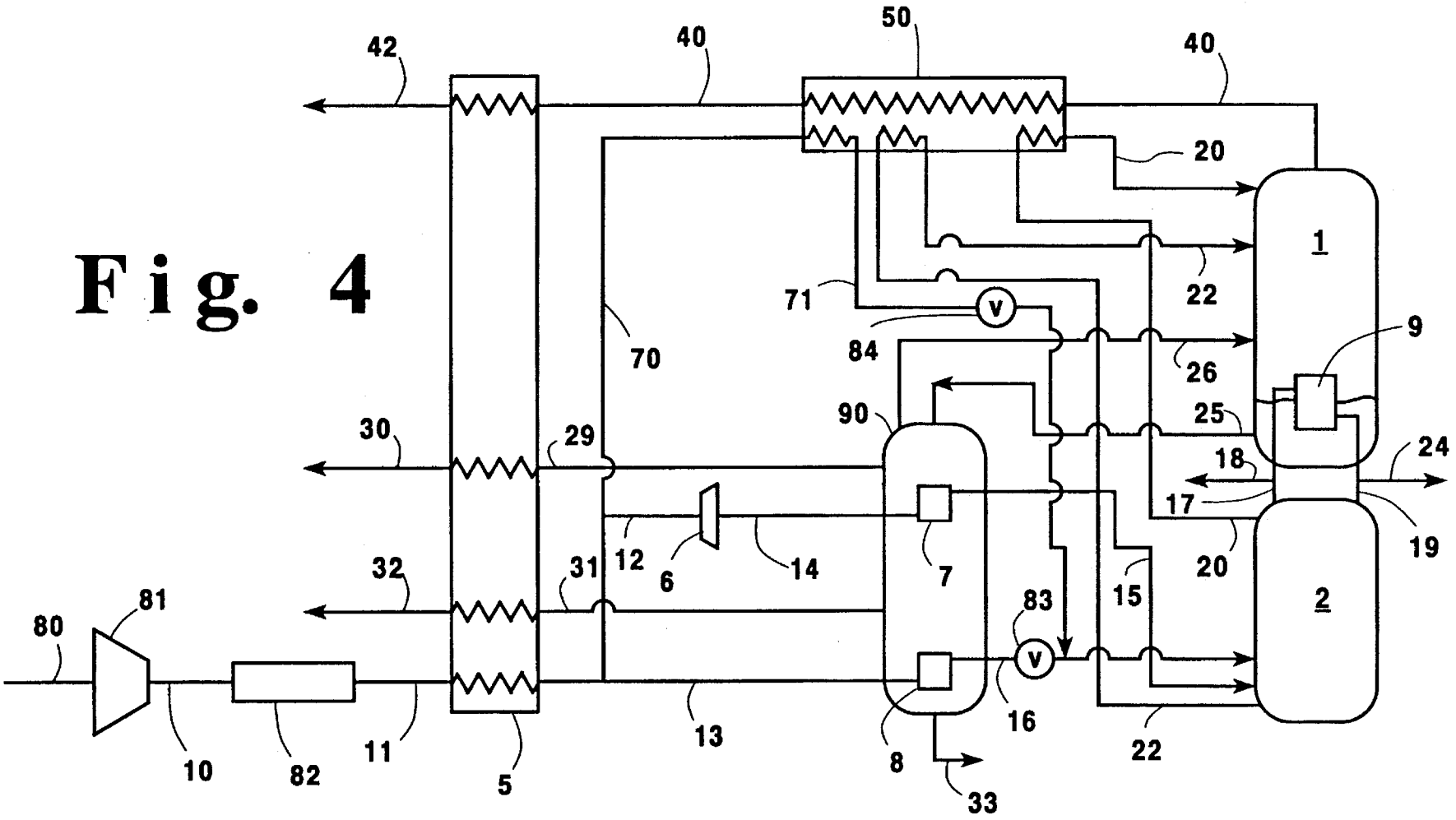
FIG. 4 is a schematic representation of a preferred embodiment of the invention wherein the two auxiliary columns are combined into a single column.

FIG. 4 illustrates another embodiment of the invention which is particularly advantageous when the oxygen product is required at a low pressure. In this embodiment a single large auxiliary column 90 is employed rather than two smaller auxiliary columns at separate pressures as are employed in the previously describe embodiments. Column 90 is operating at a pressure within the range of from 18 to 30 psia and has both first reboiler 7 and second reboiler 8. The numerals of FIG. 4 correspond to those of FIG. 1 for the common elements and these common elements will not be described again in detail.

Referring now to FIG. 4, oxygen-richer fluid is passed as stream 25 from the lower portion of lower pressure column 1 into the upper portion of auxiliary column 90 wherein it is separated by cryogenic rectification into lower purity oxygen, having an oxygen concentration which is greater than that of oxygen-richer fluid in stream 25, into higher purity oxygen having an oxygen concentration which exceeds that of the lower purity oxygen, and into remaining vapor which is returned to column 1 in stream 26. Liquid and vapor flow directly between the upper portion and lower portion of column 90. Lower purity oxygen and higher purity oxygen are recovered as previously described. Lower purity oxygen may be recovered from column 90 either from a point above first reboiler 7, as illustrated in FIG. 4, or from a point below first reboiler 7, so long as it is from a point above the point where higher purity oxygen is recovered from auxiliary column 90.

Now, by the use of this invention, one can effectively produce both higher purity oxygen and lower purity oxygen by the cryogenic rectification of feed air. Although the invention has been described in detail with reference to certain preferred embodiments, those skilled in the art will recognize that there are other embodiments of the invention within the spirit and the scope of the claims.

We claim:

1. A method for producing lower purity oxygen and higher purity oxygen comprising:

(A) at least partially condensing a first feed air portion and passing the resulting first feed air portion into a higher pressure column of a double column which also comprises a lower pressure column;

(B) at least partially condensing a second feed air portion, having a pressure less than that of the first feed air portion, and passing the resulting second feed air portion into the higher pressure column;

(C) separating feed air within the double column by cryogenic rectification to produce first oxygen-richer fluid and nitrogen-richer fluid;

(D) passing first oxygen-richer fluid from the double column into a first auxiliary column and separating the first oxygen-richer fluid within the first auxiliary column by cryogenic rectification to produce second oxygen-richer fluid having an oxygen concentration greater than that of the first oxygen-richer fluid;

(E) passing second oxygen-richer fluid from the first auxiliary column into a second auxiliary column and separating second oxygen-richer fluid within the second auxiliary column by cryogenic rectification into lower purity oxygen, having an oxygen concentration which is greater than that of the first oxygen-richer fluid and less than that of the second oxygen-richer fluid, and into higher purity oxygen, having an oxygen concentration greater than that of the lower purity oxygen; and (F) recovering lower purity oxygen and higher purity oxygen from the second auxiliary column.

2. The method of claim 1 wherein the second feed air portion is turboexpanded prior to being at least partially condensed.

3. Apparatus for producing lower purity oxygen and higher purity oxygen comprising:

(A) a double column comprising a higher pressure column and a lower pressure column, a first auxiliary column having a first reboiler, and a second auxiliary column having a second reboiler;

(B) means for passing feed air to the second reboiler and from the second reboiler into the higher pressure column;

(C) means for passing feed air to the first reboiler at a pressure less than that of the feed air passed to the second reboiler, and means for passing feed air from the first reboiler into the higher pressure column;

(D) means for passing fluid from the double column into the first auxiliary column;

(E) means for passing fluid from the first auxiliary column into the second auxiliary column; and (F) means for recovering lower purity oxygen from the second auxiliary column and means for recovering higher purity oxygen from the second auxiliary column.

4. The apparatus of claim 3 wherein the means for passing feed air to the first reboiler includes a turboexpander.

5. A method for producing lower purity oxygen and higher purity oxygen comprising:

(A) at least partially condensing a first feed air portion and passing the resulting first feed air portion into a higher pressure column of a double column which also comprises a lower pressure column;

(B) at least partially condensing a second feed air portion, having a pressure less than that of the first feed air portion, and passing the resulting second feed air portion into the higher pressure column;

(C) separating feed air within the double column by cryogenic rectification to produce oxygen-richer fluid and nitrogen-richer fluid;

(D) passing oxygen-richer fluid from the double column into an auxiliary column and separating the oxygen-richer fluid within the auxiliary column by cryogenic rectification into lower purity oxygen, having an oxygen concentration greater than that of the oxygen-richer fluid, and higher purity oxygen, having an oxygen concentration greater than that of the lower purity oxygen; and (E) recovering lower purity oxygen and higher purity oxygen from the auxiliary column.

6. The method of claim 5 wherein the second feed air portion is turboexpanded prior to being at least partially condensed.

7. Apparatus for producing lower purity oxygen and higher purity oxygen comprising:

(A) a double column comprising a higher pressure column and a lower pressure column, and an auxiliary column having a first reboiler and a second reboiler;

(B) means for passing feed air to the second reboiler and from the second reboiler into the higher pressure column;

(C) means for passing feed air to the first reboiler at a pressure less than that of the feed air passed to the second reboiler, and means for passing feed air from the first reboiler into the higher pressure column;

(D) means for passing fluid from the double column into the auxiliary column; and (E) means for recovering lower purity oxygen from the auxiliary column and means for recovering higher purity oxygen from the auxiliary column.

8. The apparatus of claim 7 wherein the means for passing feed air to the first reboiler includes a turboexpander.

* * * * *